United States Patent [19]

Ko

[11] Patent Number: 4,672,994

[45] Date of Patent: Jun. 16, 1987

[54] FIXING COVER OF A WALLED FAUCET

[76] Inventor: Hsi-Chia Ko, 69, Lane 22, Chang Ting Rd., Lu Kang Chen, Changhua Hsien, Taiwan

[21] Appl. No.: 852,366

[22] Filed: Apr. 15, 1986

[51] Int. Cl.[4] ..... F16L 5/02

[52] U.S. Cl. ..... 137/359; 137/360; 4/192; 277/183; 277/184

[58] Field of Search ..... 137/359, 360; 4/191, 4/192; 277/183, 184, 181, 187, 189; 411/369, 371, 372, 542, 533

[56] References Cited

U.S. PATENT DOCUMENTS

| | | | |
|---|---|---|---|
| 4,280,390 | 7/1981 | Murray | 411/542 |
| 4,492,817 | 1/1985 | Selby | 411/369 |
| 4,541,641 | 9/1985 | Kubo | 277/183 |
| 4,584,723 | 4/1986 | Hussauf | 4/192 |

FOREIGN PATENT DOCUMENTS

| | | | |
|---|---|---|---|
| 1012306 | 6/1977 | Canada | 137/359 |

*Primary Examiner*—Martin P. Schwadron
*Assistant Examiner*—Sheri M. Novack
*Attorney, Agent, or Firm*—Browdy and Neimark

[57] ABSTRACT

A fixing cover for a walled faucet, and more specifically, novel structure for fixture to reinforce the rear section of a faucet installed straight against a wall. It includes number of folded segments selectively distributed along the interior of a central section, to permit fitting of an annular pad by reverse setting. Thus the rebounding tension inherent inside compression members distributed along the inner diameter of the annular pad may bear against the rear portion of the faucet relative to the wall, in a manner more effective and reliable than in the prior art.

2 Claims, 5 Drawing Figures

FIXING COVER OF A WALLED FAUCET

SUMMARY OF THE INVENTION

The present invention is directed to a fixing cover of a walled faucet, and more specifically, to an innovative structure for an additional fixing fixture serving to reinforce the rear section of a faucet installed straight against an object wall. It consists of a an annular pad having number of folded segments selectively distributed along the interior of the central section, to permit fitting thereon an annular pad by reverses setting. Thus the rebounding tension inherent inside compression members distributed along the inner diameter of the annular pad may bear against the rear portion of the faucet relative to the wall, in a manner more effective and reliable than was the case with previous executions known by the trade.

In the fixing of a water faucet to the wall at right angles, it is a usual practice to cover the attaching end of the faucet with a disk-like tail cover to cover up the unsightly fixing area. In conventional practice it has been common to have tooth serrations provided inside the fixing ring in the center of the tail cover, for screw-in locking to the external serrations over the rear portion of the faucet, as is illustrated in FIG. 1. This works as follows.

Serrations 211 are provided inside the medium ring 21 of the tail cover, 2, to facilitate locking of the screw bolt 31 on the outside of the terminal end of body 3, prior to the insertion of faucet body 3 by the end terminal into the wall. Thus the tail cover 2 forms a covering means against the wall once the faucet body 3 is set into position. A major shortcoming with such prior art is that the screw-in exertion is not always so easily done, resulting in causing trouble to the body 3 in fitting tasks. What is more, the provision of tooth a lock to the tail cover necessarily requires the extra work of tapping threads between the rear portion of the body and the inside perimeter of the tail cover, thereby incurring higher costs. In addition, the threading is generally not as accurate as it should be, which further adds to difficulties encountered in screw-in endeavors, thus necessitating the use of a wrench or other tools to do the job. This often results in physical deformation of the tail cover, or damaging or scraping scratches, thereby doing much harm to the overall profile of the device.

In view of the foregoing disclosure, the industrial concerns have worked out a simple coupling type of tail cover for faucets, in which the medium ring 41 thereof is processed flat. The interior is provided with flexing points rearwards, no tapping is needed, for straight insertion into the rear portion of the faucet body, as shown on the right in FIG. 1.

The interior of the medium ring 41 of the tail cover 4 is treated to be flat and smooth, with extrusions 411 mounted rearwards along the gap area of the medium ring 41, to permit insertion of the medium ring 41 straight onto a restricting flat-headed bolting area 32 on the back section of the faucet 3. This facilitates reverse bearing of the folding extrusions 411 alongside the bolting area 32 to assist in the fixing. Since since the folding extrusions 411 and the tail cover 4 are typically integrated together, and made of metals or hard plastic, they can fail to afford reliable restriction due to lack of the required elasticity. The folding extrusions 411 proved to be of little help, since the tail cover in such arrangements sags and fails very easily.

Accordingly, the prime objective of the present invention lies in the provision of such a tail cover device for use in a walled faucet, which positive restrictive effect by being acted upon by an annularly shaped compression pad relative to flexibly engaged bolting means. The compression pad is located inside the medium ring gap of the faucet. The invention device is easy to produce, easy to assemble and brings the faucet tightly engaged to the wall when established of setting.

A further objective of the present invention lies in the provision of a tail cover facilitating the fixing of a faucet to an object wall, which can be fixed by a manual push without resorting to fixing tools. This effectively occurs without damaging the surface or shape of the tail cover in any way whatsoever.

Other features and advantages of the present invention will emerge from the following descriptions of embodiments which are given by way of illustration, and are not intended to be in any way limiting, with reference to the accompanying drawings in which:

BRIEF DESCRIPTION OF DRAWINGS

FIG. 2A is a close-up view of the invention device as seen fixed to a wall surface in a direction vertical to the ground;

FIG. 2B is a close-up view of the invention device as seen from a point parallel to and pointing straight toward the eye; and FIG. 2C is an illustration of when a compression pad is forced all the way in onto the median ring in the subject device.

DESCRIPTION OF PREFERRED EMBODIMENT

Figure 1:
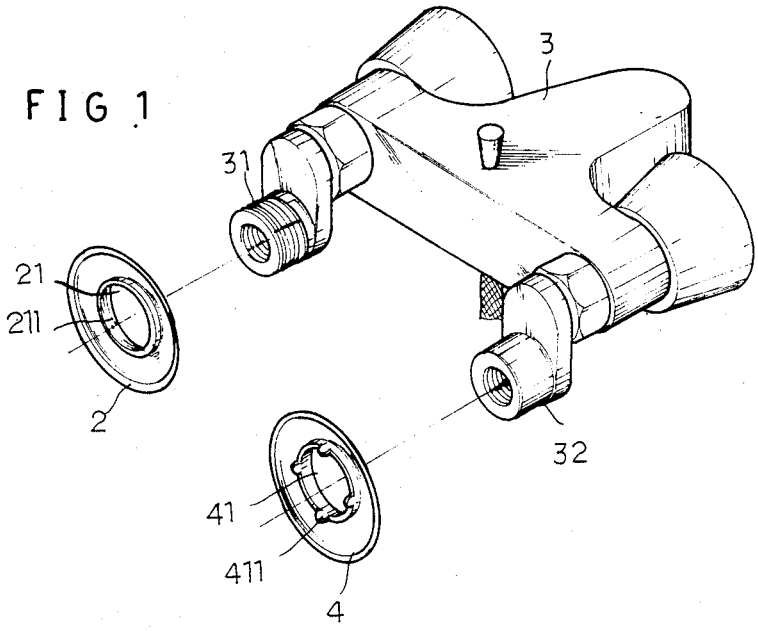
FIG. 1 is a three-dimensional view of two embodiments of a conventional tail cover adapted for use in a faucet.
Figure 1:
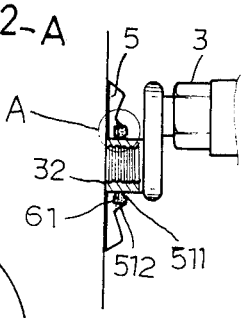
Figure 2:
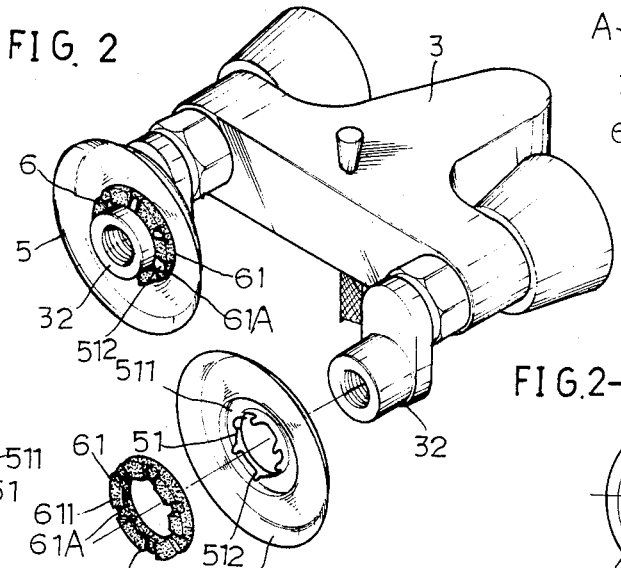
FIG. 2 is a three-dimensional perspective of the present invention.
Figure 2:
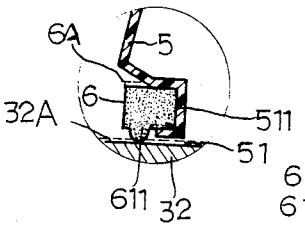
Figure 2:
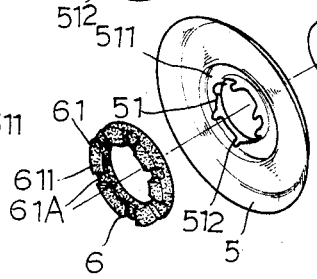
Figure 2:
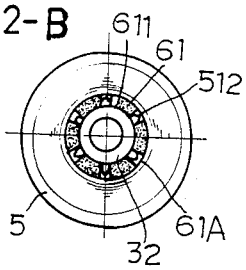

As is seen in detail in FIG. 2, the subject tail cover 5 is a metallic disk formed by flush punching, having a medium ring 51 provided in the middle. The perimeter of the ring 51 is flush-processed into an annular cavity 511 complemented by a number of pairs of oppositely standing folding lugs 512 with which to accommodate the engagement of an annular compression pad 6 into its back side, the engagement being done in a straight-in manner to render unlikely the production of an unwanted decline or free gap.

The annular compression pad 6 of suitable thickness is molded by resilient rubber or plastic materials, on one side thereof are molded a plurality of mutually complementary detents 61 spaced apart by correspondingly configured recesses 61A. The the compression pad 6 may be compelled onto the ring 51 for fitting, and once the folding lugs 512 are bent over, they enter the bottom of the recess 61A. The the interior perimeter of the detents 61 looks like a petal, and the interior of each outstanding detent 61 is further reinforced by a horizontal row of creep preventive lugs 611. Thus, as the tail cover 5 embodied with the compression pad 6 is extruded into the smooth bolting section 32 behind the faucet body 3, it will come in smoothly as if gently invited in by the detents with their gentle resistances. Thus, restrictive effects on the internal mechanism are avoided and the arrangement is correctly aligned, without engendering any deviation or unwanted clearances, as is best seen by reference to FIG. 2A and FIG. 2B.

Moreover, the resilience characteristic of the compression pad 6 is such that the bolting means 32 can be forced in disregard of its specification, or whether it's shape is inaccurate or if it is larger than it should be, so as to bring the backside of compression pad 6 bearing against the outside of recess 511, to a more secured condition; the position shift of the whole thing is indicated by dotted lines 32A, 6A in FIG. 2C.

Moreover, as the frictional coefficient of the rubber or plastic material is relatively greater, it is by no means easy to displace it linearly or in a curve. Thus, the detent lugs 611 present inside the detent washer 61 will further reduce the area of the compression point in abutment with the bolting perimeter, thereby reinforcing the tightness produced owing to the compression fitting, so that there is no need to worry about possible movements of the tail cover 5. It is clear that all these advantages as disclosed in respect of preparation, assemblage and practice constitute significant advances over conventional devices of the prior art.

I claim:

1. A tail fixing cover for a faucet to be bolted on a wall with bolting means extending as a rear side of said faucet, wherein the tail cover formed of a metallic disk and has a medium ring provided in the middle thereof, the perimeter of the medium ring having an annular recess and the interior of the medium ring having a plurality of folding lugs;

an annular compression pad is provided in the form of a thick ring made of resilient rubber of plastic, with one side thereof molded to provide correspondingly arranged detent lugs spaced in an annular row with a groove in between adjacent pairs of the detent lugs;

the compression pad is compelled for entrance into the annular recess of the gap ring for coupling engagement, and the folding lugs are to be bent outwards to permit pinched closure onto the bottom of the grooves of the compression pad, to complete the setting of the compression pad, an inner side of each detent lug on the compression pad extending to secure resilient coupling with the bolting means on the rear side of the faucet, by the reliable fitting of the tail cover to a surface of the wall is provided.

2. The tail cover of claim 1, wherein an inside surface of each detent lug bent over the annular compression pad is provided with a creep preventing rod so as to minimize the compression area and to improve the positioning strength of the compression.

* * * * *